US009429155B2

(12) United States Patent
Hüser et al.

(10) Patent No.: US 9,429,155 B2
(45) Date of Patent: Aug. 30, 2016

(54) TAPERED SOUND OUTLET VANE PUMP

(75) Inventors: Theodor Hüser, Geseke (DE); Alexander Rüther, Olsberg (DE); Udo Schubert, Paderborn (DE)

(73) Assignee: HELLA KGAA HUECK & CO., Lippstadt (DE)

( * ) Notice: Subject to any disclaimer, the term of this patent is extended or adjusted under 35 U.S.C. 154(b) by 0 days.

(21) Appl. No.: 13/480,111

(22) Filed: May 24, 2012

(65) Prior Publication Data

US 2013/0045126 A1 Feb. 21, 2013

(30) Foreign Application Priority Data

Nov. 26, 2009 (DE) ..... 10 2009 056 010
Nov. 25, 2010 (WO) ..... PCT/EP2010/068177

(51) Int. Cl.

| | |
|---|---|
| ***F04C 2/344*** | (2006.01) |
| ***F04B 49/18*** | (2006.01) |
| ***G10K 11/02*** | (2006.01) |
| ***F01N 13/08*** | (2010.01) |
| ***F04C 15/00*** | (2006.01) |
| ***F04C 15/06*** | (2006.01) |

(52) U.S. Cl.

CPC ..... *F04C 2/3446* (2013.01); *F04C 15/0049* (2013.01); *F04C 15/06* (2013.01); *F04C 2240/30* (2013.01); *F04C 2250/102* (2013.01); *F04C 2270/13* (2013.01)

(58) Field of Classification Search

USPC ..... 418/181, 87, 15; 417/302, 76, 79, 87, 417/88; 181/250, 266, 273, 276, 403, 166

See application file for complete search history.

(56) References Cited

U.S. PATENT DOCUMENTS

| | | | | |
|---|---|---|---|---|
| 1,854,692 | A | 4/1932 | Cooper | |
| 2,293,181 | A * | 8/1942 | Terman | 181/166 |
| 3,997,020 | A * | 12/1976 | Busnel et al. | 181/175 |
| 6,050,362 | A * | 4/2000 | Feijen | 181/232 |
| 6,377,696 | B1 * | 4/2002 | Nevill | 381/345 |
| 7,114,525 | B2 * | 10/2006 | Krieger et al. | 138/44 |

FOREIGN PATENT DOCUMENTS

| | | |
|---|---|---|
| CN | 201241828 Y | 5/2009 |
| DE | 2420905 A1 | 12/1974 |
| JP | 58134693 U | 9/1983 |

OTHER PUBLICATIONS

Didge Design (www.navaching.com/skaku/didge.html), Aug. 14, 2009.*

International Preliminary Report on Patentability for PCT/EP2010/068177 dated Jun. 5, 2012 (English translation).

* cited by examiner

*Primary Examiner* — Jesse Bogue
*Assistant Examiner* — Deming Wan
(74) *Attorney, Agent, or Firm* — Husch Blackwell LLP

(57) ABSTRACT

The invention relates to a vane cell pump comprising an electrical pump unit that has a pump chamber into and out of which a fluid can flow and also a rotor with a number of vanes to compress the fluid before flowing out from the pump chamber. The vane cell pump also comprises a sound-damping mechanism into which the fluid can flow after flowing through the pump chamber and that has a sound-damping cover attached to a part of the pump chamber and defining a sound-damping volume. A preliminary sound-damping mechanism with at least one preliminary sound-damping outlet from which the fluid can flow may be arranged within the sound-damping volume, wherein the preliminary sound-damping outlet has a cross-sectional profile tapering in the direction of fluid outflow.

11 Claims, 3 Drawing Sheets

TAPERED SOUND OUTLET VANE PUMP

CROSS-REFERENCE TO RELATED APPLICATIONS

This application claims priority to German Application No. 10 2009 056 010.6 filed on Nov. 26, 2009 and Application No. PCT/EP2010/068177 filed on Nov. 25, 2010.

BACKGROUND

The present invention relates to a vane cell pump comprising an electrical pump unit that has a pump chamber into and out of which a fluid can flow and also a rotor with a number of vanes that are arranged so that they can move in the rotor and by means of which the fluid can be compressed before flowing out from the pump chamber. The vane cell pump according to the invention also comprises a sound-damping mechanism into which the fluid can flow after flowing through the pump chamber and that has a sound-damping cover attached to a part of the pump chamber and defining a sound-damping volume, wherein a preliminary sound-damping mechanism with at least one preliminary sound-damping outlet from which the fluid can flow is arranged within the sound-damping volume.

Vane cell pumps of the type named above, which are also frequently called rotary vane pumps, are already known in various constructions from the prior art. Examples for vane cell pumps can be found in DE 100 24 699 A1, DE 199 36 644 B4, DE 102006 058 977 A1, DE 102006 058 978 A1, DE 102006 058 979 A1, and DE 10 2006 058 980 A1.

To be able to damp the noises generated when the vane cell pump is operating, the vane cell pumps known from the prior art use a sound-damping mechanism that can be formed, in particular, by a sound-damping cover mounted on a part of the vane cell pump (especially on a mounting plate) and defining, together with a part of the pump ring, a sound-damping volume. After passing through the pump ring within which the fluid is compressed, the fluid flows first into the sound-damping volume and then, after flowing through the sound-damping volume, the fluid leaves the vane cell pump through (at least) one fluid outlet opening that communicates in terms of carrying a flow with the sound-damping volume.

To further reduce the noise level while the vane cell pump is operating, it is further known from the prior art to use an additional preliminary sound-damping mechanism that can be arranged, in particular, within the sound-damping volume and has a preliminary sound-damping outlet from which the fluid can flow. The fluid compressed within the pump chamber flows first out from the pump chamber into the preliminary sound-damping mechanism, through this mechanism, out through the preliminary sound-damping outlet, and then into the remaining sound-damping volume. Then the fluid leaves the vane cell pump through (at least) one fluid outlet opening that communicates in terms of carrying a flow with the sound-damping volume.

The preliminary sound-damping mechanisms known from the prior art have slot-shaped preliminary sound-damping outlets through which the fluid must pass when leaving the preliminary sound-damping mechanism. In terms of flow, there is a cross-sectional jump from a large flow cross section within the preliminary sound-damping mechanism to a considerably smaller flow cross section when flowing through the slot-shaped preliminary sound-damping outlet. It has been shown that such a construction of the preliminary sound-damping outlet has a negative effect on the output of the vane cell pump. The noise level of this vane cell pump is indeed lower than in vane cell pumps that do not have additional preliminary sound-damping mechanisms. The geometry of the preliminary sound-damping outlet with a cross-sectional jump from a large flow cross section to a small flow cross section caused by the slot-shaped construction of the preliminary sound-damping outlet leads to noticeable output throttling of the vane cell pump.

SUMMARY OF THE INVENTION

The present invention addresses this problem and sets itself the task of disclosing a vane cell pump of the type named above, which makes low-noise operation possible without the associated output throttling.

This task is achieved by a vane cell pump comprising an electrical pump unit that has a pump chamber into and out of which a fluid can flow and also a rotor with a number of vanes that are arranged so that they can move in the rotor and by means of which the fluid can be compressed before flowing out from the pump chamber and also comprising a sound-damping mechanism into which the fluid can flow after flowing through the pump chamber and that has a sound-damping cover attached to a part of the pump chamber and defining a sound-damping volume, wherein a preliminary sound-damping mechanism with at least one preliminary sound-damping outlet from which the fluid can flow is arranged within the sound-damping volume, characterized in that the preliminary sound-damping outlet has a cross-sectional profile tapering in the direction of fluid outflow. The dependent claims relate to advantageous refinements of the invention.

A vane cell pump according to the invention is characterized in that the preliminary sound-damping outlet has a cross-sectional profile tapering continuously in the direction of fluid outflow. Surprisingly, it has been shown that such a construction of the preliminary sound-damping outlet produces no perceptible output losses when the vane cell pump is operating.

In one especially advantageous embodiment, the preliminary sound-damping outlet has a cross-sectional profile tapering continuously in the direction of fluid outflow. Therefore, in an especially advantageous way, absolutely no cross-sectional jumps or steps in the cross-sectional profile are present in the area of the preliminary sound-damping outlet.

In one preferred embodiment, there is the possibility that the preliminary sound-damping outlet has a conical shape at least in some sections in the direction of fluid outflow. In one alternative, especially preferred embodiment, it is proposed that the cross-sectional profile of the preliminary sound-damping outlet has tapering elliptical contours at least in some sections in the direction of the fluid outflow. In one alternative, preferred embodiment, the cross-sectional profile of the preliminary sound-damping outlet has truncated-pyramid-shaped contours at least in some sections in the direction of the fluid outflow.

To realize efficient preliminary sound damping, in one especially preferred embodiment, it is provided that the preliminary sound-damping mechanism has a preliminary sound-damping sleeve in which the preliminary sound-damping outlet is constructed or that communicates in terms of carrying a flow with the preliminary sound-damping outlet. Advantageously, the preliminary sound-damping sleeve can have a tube-shaped construction.

To further increase the sound damping, in one especially preferred embodiment it is proposed that the preliminary sound-damping sleeve is made from a sound-damping material, in particular, rubber. Advantageously, the preliminary sound-damping sleeve can extend within the sound-damping volume between a cover plate of the pump ring and the sound-damping cover.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The invention will be explained in more detail below with reference to the accompanying drawings. Shown are.

DETAILED DESCRIPTION

Figure 1:
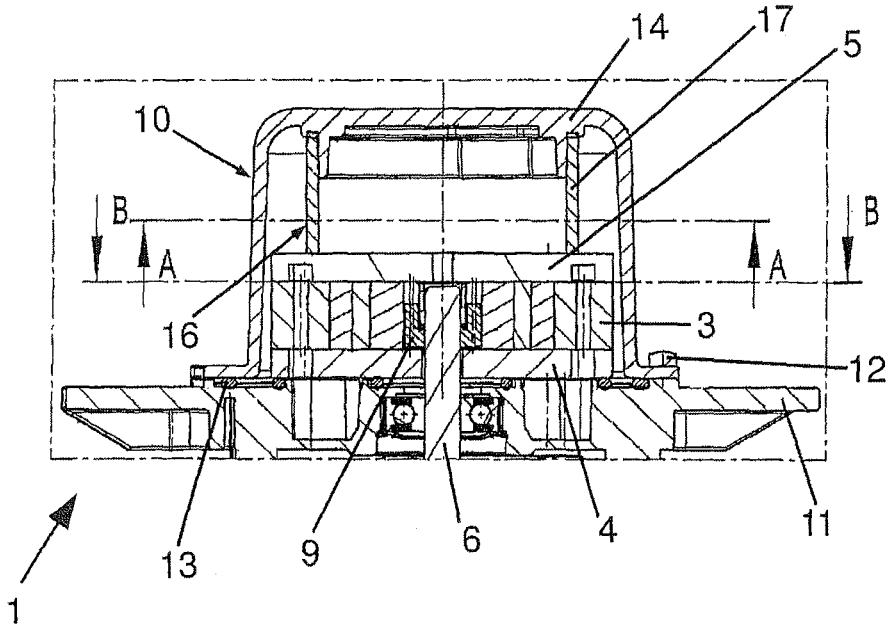
FIG. 1 shows a longitudinal section through a vane cell pump according to a preferred embodiment of the present invention.

The basic structural shape and the basic functional principle of a vane cell pump 1 made according to a preferred embodiment of the present invention are known from the prior art and will be explained in more detail below. The vane cell pump 1 comprises an electrical drive unit that is housed in a housing of the vane cell pump 1 and has an electric motor with a motor shaft 6. The vane cell pump 1 (rotary vane pump) can be constructed, in particular, as a vacuum pump operating according to the so-called principle of positive displacement for generating a vacuum. Air or another fluid medium is taken in via a fluid inlet channel 15 constructed in the present case as a fluid inlet port when the vane cell pump 1 is operating and flows into a pump chamber 2 of the vane cell pump 1 and is compressed there.

The pump chamber 2 comprises an interconnected base plate 4, a pump ring 3, and a cover plate 5. In this embodiment, the pump ring 3 has elliptical inner contours (visible, in particular, in FIG. 3) with a correspondingly shaped inner wall 30. In an alternative embodiment there is also the possibility that the pump ring 3 has a circular ring shape and circular inner contours.

In the interior of the pump chamber 2 there is a cylindrical rotor 7 in active connection with the motor shaft 6 of the drive unit. The rotor 7 is driven by the motor shaft 6 of the electric motor when the vane cell pump 1 is operating and thus the rotor is set in rotation. For this purpose, the rotor 7 is locked in rotation with the motor shaft 6 by means of a correspondingly shaped catch 9. The catch 9 is locked in rotation on its side to the motor shaft 6 of the electric motor.

Figure 3:
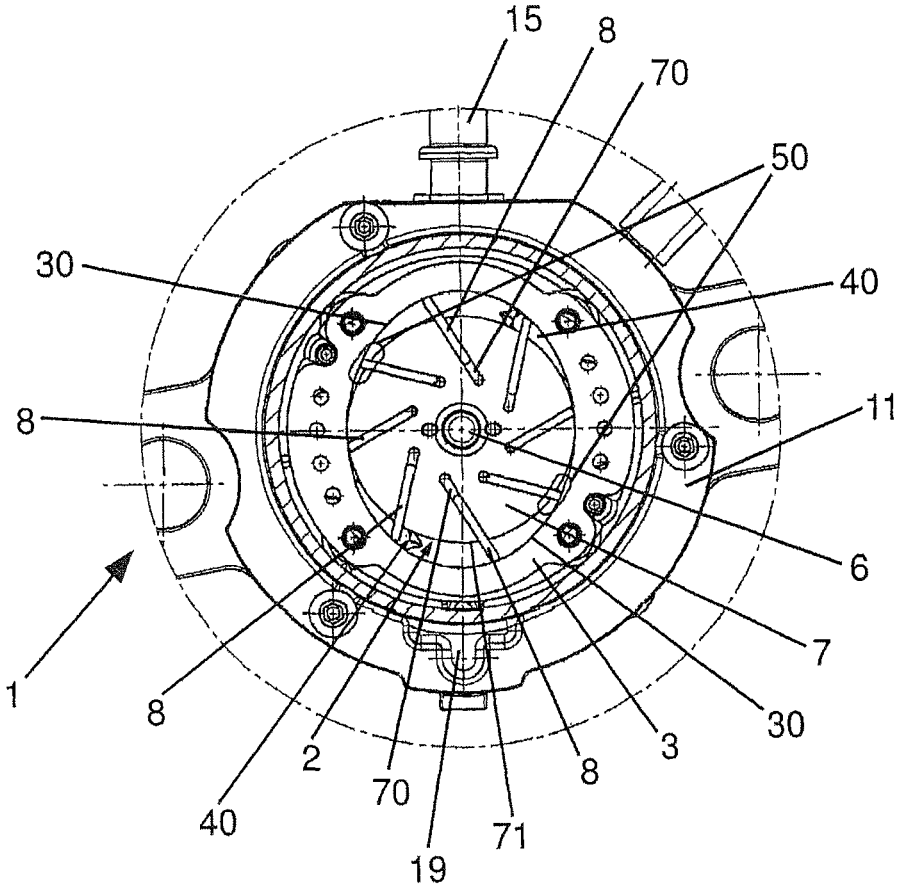
FIG. 3 shows a section through the vane cell pump along the line B-B according to FIG. 1.

The rotor 7 has a number of guide slots 70 each of which are suitable for holding a vane 8. In this embodiment, the rotor 7 has a total of eight guide slots 70 that are distributed around the circumference of the rotor and that extend inward from the outer circumference of the rotor. Each of the vanes 8 is arranged so that it can move in one of the guide slots 70. The rotor 7 is driven by the motor shaft 6 of the electric motor when the vane cell pump 1 is operating and thus the rotor is set in rotation. As can be seen in FIG. 3, the vanes 8 form work cells of different sizes depending on their rotational position with the inner wall 30 of the pump ring 3, the outer wall 71 of the rotor 7, and possibly adjacent vanes 8.

Furthermore, the vane cell pump 1 has a mounting plate 11 to which is attached a housing that is not shown here explicitly and in which the electric motor is stored. The mounting plate 11 could alternatively also be part of the housing. Furthermore, a sealing ring 13 is provided that is arranged on the mounting plate 11 during assembly. The sealing ring 13 is suitable for sealing a sound-damping cover 14 that seals the vane cell pump 1 on the end and forms a part of a sound-damping mechanism 10 of the vane cell pump 1. The sound-damping cover 14 is screwed to the mounting plate 11 with the help of suitable attachment screws 12.

When the vane cell pump 1 is operating, the fluid flows through the fluid inlet channel 15 and from there through corresponding fluid outlet openings of the mounting plate 11 and then into the pump chamber 2 through two fluid inlet openings 40 that are arranged offset from each other by 180° (and thus opposite each other) and constructed in the base plate 4. The vanes 8 of the rotating rotor 7 compress the fluid and drive it to two fluid outlet openings 50 that are provided offset from each other by 180° in the cover plate 5 of the pump chamber 2 and are arranged offset relative to the fluid inlet openings 40 of the base plate 4 by approximately 90° and constructed as elongated openings. The damping volume of the sound-damping mechanism 10 is spatially defined in the present case essentially by the surface of the cover plate 5 and the sound-damping cover 14, which enclose the damping volume. In the interior of the sound-damping volume there is a preliminary sound-damping mechanism 16 that is formed in this embodiment by a preliminary sound-damping sleeve 17 extending between the cover plate 5 and the sound-damping cover 14 and a preliminary sound-damping outlet 18. The preliminary sound-damping outlet 18 can be formed in the preliminary sound-damping sleeve 17 or can communicate in terms of carrying a flow with the preliminary sound-damping sleeve 17. The preliminary sound-damping sleeve 17 advantageously has a tube-like construction and is made from a sound-damping material, in particular, rubber.

The part of the sound-damping volume that is defined by that part of the sound-damping cover 14 bordering a first outer edge section of the preliminary sound-damping sleeve 17, the part of the mounting plate 5 bordering a second outer edge section of the preliminary sound-damping sleeve 17, and also the preliminary sound-damping outlet 18 form the preliminary sound-damping mechanism 16 of the vane cell pump 1 and thus also define the preliminary sound-damping volume. After flowing through the pump chamber 2, the fluid flows through the two fluid outlet openings 50 of the cover plate 5 first into the preliminary sound-damping volume of the preliminary sound-damping mechanism 16 and then through the preliminary sound-damping outlet 18 into the rest of the sound-damping volume of the sound-damping mechanism 10. Then the fluid flows to a fluid outlet area 19 (see FIG. 3) and flows out from the vane cell pump 1 through this area.

Figure 2:
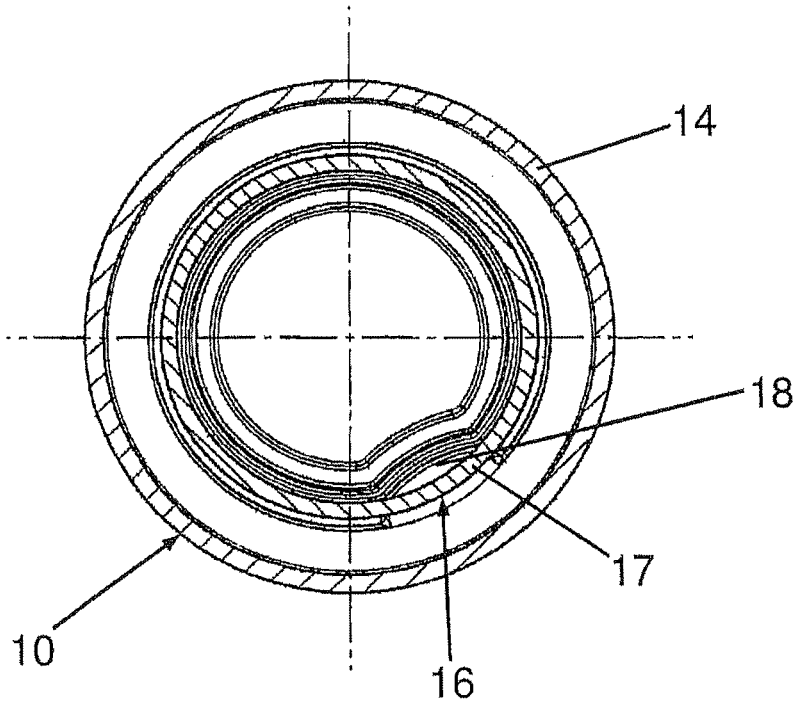
FIG. 2 shows a section through the vane cell pump along the line A-A according to FIG. 1.

In the present case, the preliminary sound-damping outlet 18 has a cross-section tapering continuously in the direction of fluid outflow. Thus, the shape of the preliminary sound-damping outlet 18 differs considerably from those of the solutions known from the prior art in which the preliminary sound-damping outlet defines a cross-sectional jump and can be constructed, in particular, with a slot-like shape. The special shape of the preliminary sound-damping outlet 18 with cross-sectional tapering in the direction of fluid outflow has the advantage that there are no output losses of the vane cell pump 1 in this area, as frequently observed in the solutions known from the prior art. The shape of the outlet geometry of the preliminary sound-damping outlet 18 with the cross-sectional tapering is such that effective noise damping can be achieved without the typical throttling of the output of the vane cell pump 1. Advantageously, the preliminary sound-damping outlet 18 has a cross-sectional profile tapering continuously in the direction of fluid flow. In this way it is achieved that absolutely no cross-sectional jumps or steps in the cross-sectional profile are present in the area of the preliminary sound-damping outlet 18. In the present invention, the cross-sectional profile of the preliminary sound-damping outlet 18 has a tapering, oval cross section, in particular, elliptically shaped contours, at least in some sections. As shown in FIG. 2, sound-dampening outlet 18 may have a generally oval cross-sectional profile which is defined as the intersection between two circles. Alternatively, the preliminary sound-damping outlet 18 can have conical or truncated-pyramid-shaped contours at least in some sections.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

REFERENCE LIST

1 Vane cell pump
2 Pump chamber
3 Pump ring
4 Base plate
5 Cover plate
6 Motor shaft
7 Rotor
8 Vane
9 Catch
10 Sound-damping mechanism
11 Mounting plate
12 Attachment screw
13 Sealing ring
14 Sound-damping cover
15 Fluid inlet channel
16 Preliminary sound-damping mechanism
17 Preliminary sound-damping sleeve
18 Preliminary sound-damping outlet
19 Fluid outlet area
30 Inner wall
70 Guide slot
71 Outer wall

What is claimed is:

1. A vane cell pump comprising:

an electrical pump unit that has a pump chamber into and out of which a fluid can flow;

a rotor with a number of vanes; said vanes being arranged to move in the rotor such that the fluid can be compressed before flowing out from the pump chamber;

a sound-damping mechanism in fluid communication with the pump chamber;

a sound-damping cover attached to a part of the pump chamber such that a sound-damping volume is defined;

a preliminary sound-damping mechanism with at least one preliminary sound-damping outlet from which the fluid can flow, said preliminary sound-damping mechanism being at least partially within the sound-damping volume;

the preliminary sound-damping outlet having a cross-sectional profile formed as a shape occurring between two opposing arcuate lines which intersect at two vertices, said cross-sectional profile being located at an entrance to said preliminary sound-damping outlet, said profile tapering only in the direction of fluid outflow.

2. The vane cell pump according to claim 1, wherein the preliminary sound-damping outlet has a cross-sectional profile tapering continuously in the direction of fluid outflow.

3. The vane cell pump according to claim 1, wherein the preliminary sound-damping outlet has a conical shape at least in some sections.

4. The vane cell pump according to claim 1, wherein the cross-sectional profile of the preliminary sound-damping outlet has tapering, truncated-pyramid-shaped contours at least in some sections.

5. The vane cell pump according to claim 1, wherein the preliminary sound-damping mechanism has a preliminary sound-damping sleeve; the preliminary sound-damping outlet being at least partially within the sleeve, such that the sleeve carries a flow with the preliminary sound-damping outlet.

6. The vane cell pump according to claim 5, wherein the preliminary sound-damping sleeve has a tube-like construction.

7. The vane cell pump according to claim 5, wherein the preliminary sound-damping sleeve is made from a sound-damping material.

8. The vane cell pump of claim 7 wherein said sleeve is rubber.

9. The vane cell pump according to claim 5, further comprising the preliminary sound-damping sleeve extending within the sound-damping volume between a cover plate of the pump ring and the sound-damping cover.

10. A vane cell pump comprising:

an electrical pump unit that has a pump chamber into and out of which a fluid can flow;

a rotor with a number of vanes, said vanes being arranged to move in the rotor such that the fluid can be compressed before flowing out from the pump chamber;

a sound-damping mechanism in fluid communication with the pump chamber, said sound-damping mechanism including a sound-damping cover attached to a part of the pump chamber such that a sound-damping volume is defined within the sound-damping cover and above a cover plate therewithin;

a preliminary sound-damping mechanism including a preliminary sound-damping sleeve at least partially within the sound-damping volume, said preliminary sound-damping mechanism further including at least one preliminary sound-damping outlet from which the fluid can flow;

the preliminary sound-damping outlet having a cross-sectional profile formed as a shape occurring between two opposing arcuate lines which intersect at two vertices, said cross-sectional profile being located at an entrance to said preliminary sound-damping outlet, said profile tapering only in the direction of fluid outflow.

11. A vane cell pump comprising:

an electrical pump unit that has a pump chamber into and out of which a fluid can flow;

a rotor with a number of vanes, said vanes being arranged to move in the rotor such that the fluid can be compressed before flowing out from the pump chamber;

a sound-damping mechanism in fluid communication with the pump chamber, said sound-damping mechanism including a sound-damping cover attached to a part of the pump chamber such that a sound-damping volume is defined within the sound-damping cover and above a cover plate therewithin;

a preliminary sound-damping mechanism including a preliminary sound-damping sleeve at least partially within the sound-damping volume, said preliminary sound-damping mechanism further including at least one preliminary sound-damping outlet from which the fluid can flow;

the preliminary sound-damping outlet having a cross-sectional profile at an entrance to said preliminary sound-damping outlet, said profile tapering only in the direction of fluid outflow, wherein said cross-sectional profile is formed as a shape occurring between two opposing arcuate lines which intersect at two vertices.

* * * * *